United States Patent [19]

Kuriyama et al.

[11] Patent Number: 4,790,147

[45] Date of Patent: Dec. 13, 1988

[54] HELIUM COOLING APPARATUS

[75] Inventors: Toru Kuriyama, Yokohama; Ryuichi Hakamada, Tokyo, both of Japan

[73] Assignee: Kabushiki Kaisha Toshiba, Kawasaki, Japan

[21] Appl. No.: 120,547

[22] Filed: Nov. 13, 1987

[30] Foreign Application Priority Data

Nov. 18, 1986 [JP] Japan ..... 61-274891

[51] Int. Cl.[4] ..... F25B 19/00

[52] U.S. Cl. ..... 62/514 R; 62/54; 165/104.21

[58] Field of Search ..... 62/45, 50, 55, 514 R, 62/54; 165/104.21

[56] References Cited

U.S. PATENT DOCUMENTS

| | | | |
|---|---|---|---|
| 2,944,405 | 7/1960 | Basore et al. | 62/54 |
| 3,108,447 | 10/1963 | Maher et al. | 62/54 |
| 3,369,371 | 2/1968 | Holly et al. | 62/54 |
| 3,791,422 | 2/1974 | Johnson et al. | 62/54 |
| 3,986,550 | 10/1976 | Mitsuoka | 165/104.33 |
| 4,599,866 | 7/1986 | Nakagome et al. | 62/3 |

FOREIGN PATENT DOCUMENTS

| | | |
|---|---|---|
| 0131652 | 1/1985 | European Pat. Off. . |
| 0142117 | 5/1985 | European Pat. Off. . |
| 6073264 | 4/1985 | Japan . |
| 1433727 | 4/1976 | United Kingdom . |

*Primary Examiner*—Ronald C. Capossela
*Attorney, Agent, or Firm*—Oblon, Fisher, Spivak, McClelland & Maier

[57] ABSTRACT

A helium cooling apparatus includes a liquid helium container which stores liquid helium and a condensation chamber incorporating a condensation heat exchanger for condensing a gas helium into liquid helium. A transfer tube allows the liquid helium container to communicate with the condensation chamber. The transfer tube has a gas flow path and a liquid helium flow path independently thereof. When the liquid helium in the liquid helium container is evaporated into gas helium, the gas helium is guided to the condensation chamber through the gas helium flow path. The gas helium is condensed by a condensation heat exchanger into liquid helium. The liquid helium is guided to the liquid helium container through the liquid helium flow path.

15 Claims, 6 Drawing Sheets

HELIUM COOLING APPARATUS

FIELD OF THE INVENTION

The present invention relates to a helium cooling apparatus for cooling a gas helium evaporated in a liquid helium container and condensing the gas helium again into liquid helium. More particularly, the present invention relates to a helium cooling apparatus comprising a transfer tube for causing a liquid helium container to communicate with a condensation chamber which incorporates a condensation heat exchanger, and for feeding the condensed liquid helium and the evaporated gas helium.

BACKGROUND OF THE INVENTION

A conventional helium cooling apparatus of this type is arranged, as shown in FIG. 1. The helium cooling apparatus 1 comprises a liquid helium container 3 which stores liquid helium 6 at a predetermined liquid level, and a condensation chamber 5 which incorporates a condensation heat exchanger 4. The container 3 is arranged in a cryostat 2. An object 7 to be cooled (e.g., a superconducting magnet) is immersed in the liquid helium 6 in the container 3. The liquid helium container 3 has a port 9, and a pipe 10 open to the external atmosphere is connected to the port 9. The liquid helium container 3 communicates with the condensation chamber 5 through a transfer tube 11. The transfer tube 11 is inserted into the pipe 10 and the port 9. The condensation heat exchanger 4 is connected to a refrigerator 8 for supplying a refrigerant to the heat exchanger 4.

The liquid helium 6 in the liquid helium container 3 is gradually evaporated by a heat energy transferred from the external atmosphere to the container 3. The evaporated gas helium is supplied to the condensation chamber 5 through the transfer tube 11. The temperature of a heat conduction surface of the condensation heat exchanger 4 is set at 4.2 K. The gas helium is condensed again into liquid helium by the condensation heat exchanger 4. The liquid helium descends in the transfer tube 11 by gravity and returns to the container 3. The amount of liquid helium 6 in the container 3 is kept constant, and the object 7 can be satisfactorily cooled.

When the heat energy transferred to the liquid helium container 3 is increased, the amount of the gas helium evaporated in the liquid helium container 3 is increased. Therefore, the flow rate of the gas helium ascending through the transfer tube 11 is increased, and the liquid helium descending through the transfer tube 11 is forced to ascend together with the gas helium. More specifically, the inside of the transfer tube 11 is blocked by the gas helium ascending through the transfer tube 11, so that the liquid helium cannot descend through the transfer tube 11. (This phenomenon is called a flooding phenomenon.) As a result, the liquid helium 6 in the liquid helium container 3 is continuously evaporated by the heat energy transferred from the external atmospher to the container 3, and the amount of the liquid helium 6 in the container 3 is decreased. As a result, it is difficult to cool the object 7.

The flooding phenomenon is determined by the inner diameter of the transfer tube 11, the flow rate of the liquid helium descending through the transfer tube 11, and the flow rate of the gas helium ascending through the transfer tube 11. The flow rates of the liquid helium and the gas helium are determined by the heat energy transferred from the external atmosphere to the liquid helium container 3.

The present inventors made several tests, using the conventional helium cooling apparatus, to obtain a relationship between the level of the liquid helium in the container 3 and the lapse of time and relationship between the level of the liquid helium in the chamber 5 and the lapse of time. In these tests, the transfer tube 11 of the helium cooling apparatus has an inner diameter of 5 mm, and the heat energies of 0.5 W and 0.7 W were transferred from the external atmosphere to the liquid helium container 3.

As is apparent from FIG. 2, when 0.5 W heat energy is transferred to the liquid helium container 3, the liquid level in the container 3 is kept constant independently of time lapse. However, when the heat energy of 0.7 W is transferred to the liquid helium container 3, the flooding phenomenon occurs. In other words, most of the liquid the helium in helium container 3 is evaporated by the heat energy and is converted into the gas helium, which is then fed to the condensation chamber 5 through the transfer tube 11. Thus, the inside of the transfer tube 11 is blocked by the gas helium ascending through the transfer tube 11, so that the liquid helium in the condensation chamber 5 cannot descend through the transfer tube 11. Accordingly, when the heat energy of 0.7 W is transferred to the liquid helium container 3, the liquid level in the container 3 is lowered, while the liquid level in the chamber 5 is raised. Thus, if the inner diameter of the transfer tube 11 is 5 mm, the helium cooling apparatus cannot have a cooling capacity of 0.7 W or more. For example, even if the refrigerator 8 has a refrigeration capacity of 4 to 5 W and the condensation heat exchanger 4 has a condensation capacity of 4 to 5 W, the energy subjected to actual condensation is 0.7 W or less. In order to prevent the flooding phenomenon and to maximize the condensation capacity of the helium cooling apparatus, the inner diameter of the transfer tube 11 must be relatively large.

When the inner diameter of the transfer tube 11 is relatively large, the sizes of the port 9 and the pipe 10, both of which receive the transfer tube 11, must be increased. As a result, the heat energy transferred from the external atmosphere to the helium container 3 through the port 9 and the pipe 10 is increased. In other words, when the inner diameter of the transfer tube 11 is increased, the flooding phenomenon in the transfer tube 11 can be prevented, and a satisfactory cooling capacity of the helium cooling apparatus can be obtained. However, the heat energy transferred to the helium container 3 is undesirably increased. For this reason, the inner diameter of the transfer tube 11 must be decreased. In this case, however, a flooding phenomenon occurs, and the satisfactory cooling capacity of the helium cooling apparatus cannot be obtained.

It is, therefore, difficult to obtain a satisfactory cooling capacity of the helium cooling apparatus while the inner diameter of the transfer tube 11 is kept small and the flooding phenomenon is prevented. In other words, it is difficult to obtain a satisfactory cooling capacity of the helium cooling apparatus while the apparatus is kept compact.

OBJECTS OF THE INVENTION

It is an object of the present invention to provide a compact helium cooling apparatus having a satisfactory cooling capacity.

It is another object of the present invention to provide a helium cooling apparatus which prevents a flooding phenomenon even if an inner diameter of the transfer tube is not increased.

SUMMARY OF THE INVENTION

A helium cooling apparatus according to the present invention comprises a liquid helium container which stores a liquid helium container which stores a liquid helium. The apparatus further comprises a condensation chamber which incorporates a condensation heat exchanger for condensing gas helium into liquid helium. A transfer tube allows the liquid helium container to communicate with the condensation container. The transfer tube includes independent gas helium and liquid helium flow paths.

When the liquid helium in the liquid helium container is evaporated and converted into gas helium, the gas helium is guided to the condensation chamber through the gas helium flow path. The gas helium is condensed by the condensation heat exchanger into liquid helium. The liquid helium is guided to the liquid helium container through the liquid helium flow path. In other words, the gas and liquid helium flow paths in the transfer tube are separated from each other. For this reason, the gas helium does not interfere with the liquid helium, and gas and liquid helium components can flow through independent flow paths. Therefore, the flooding phenomenon tends not to occur in the transfer tube. Even if the inner diameter of the transfer tube is not relatively large, the cooling capacity of the helium cooling apparatus is not degraded. As a result, there is provided a compact helium cooling apparatus having a satisfactory cooling capacity.

DETAILED DESCRIPTION OF THE PREFERRED EMBODIMENTS

Figure 1:
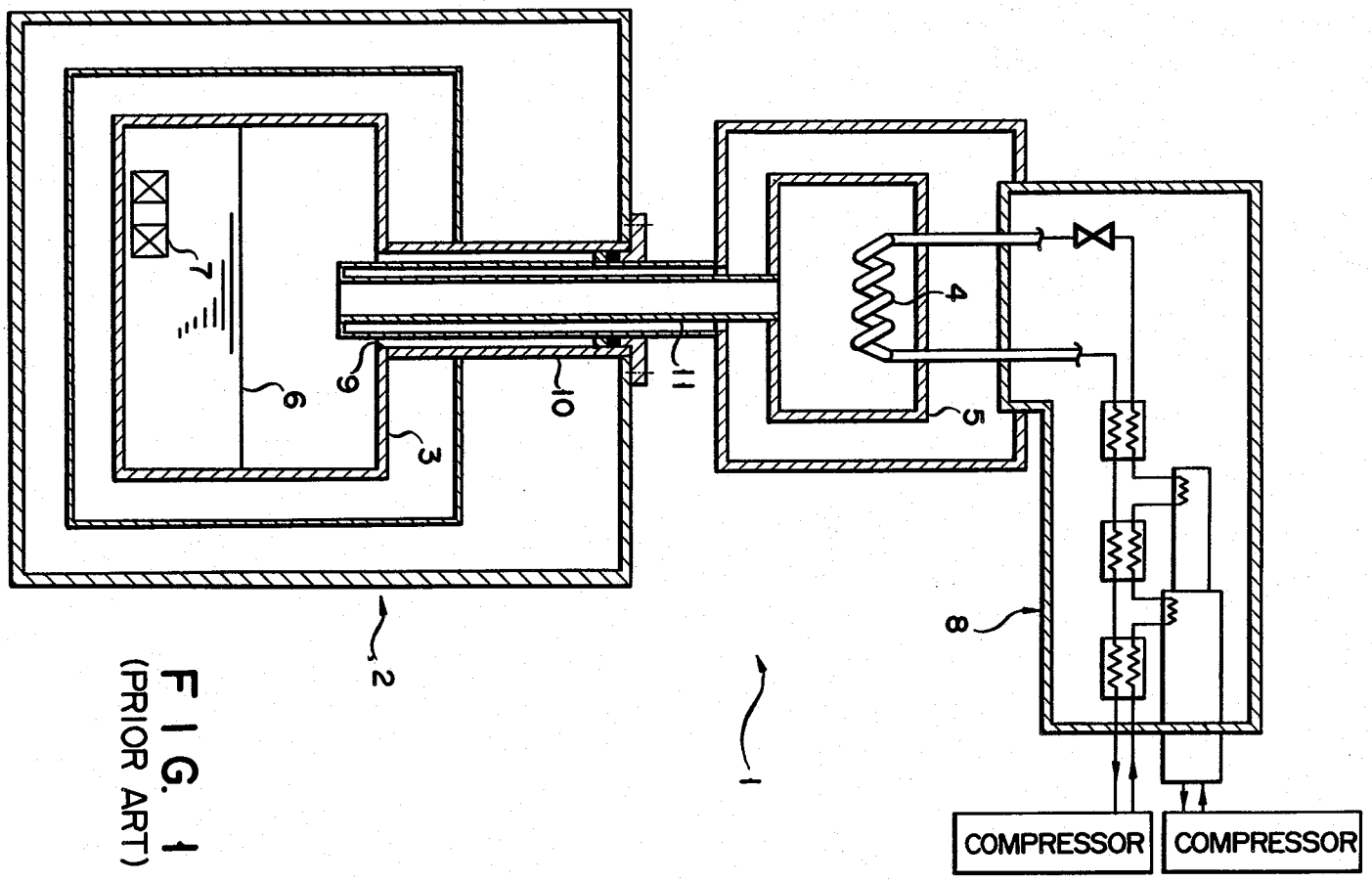
FIG. 1 (PRIOR ART)
FIG. 1 is a sectional view of a conventional helium cooling apparatus.
Figure 2:
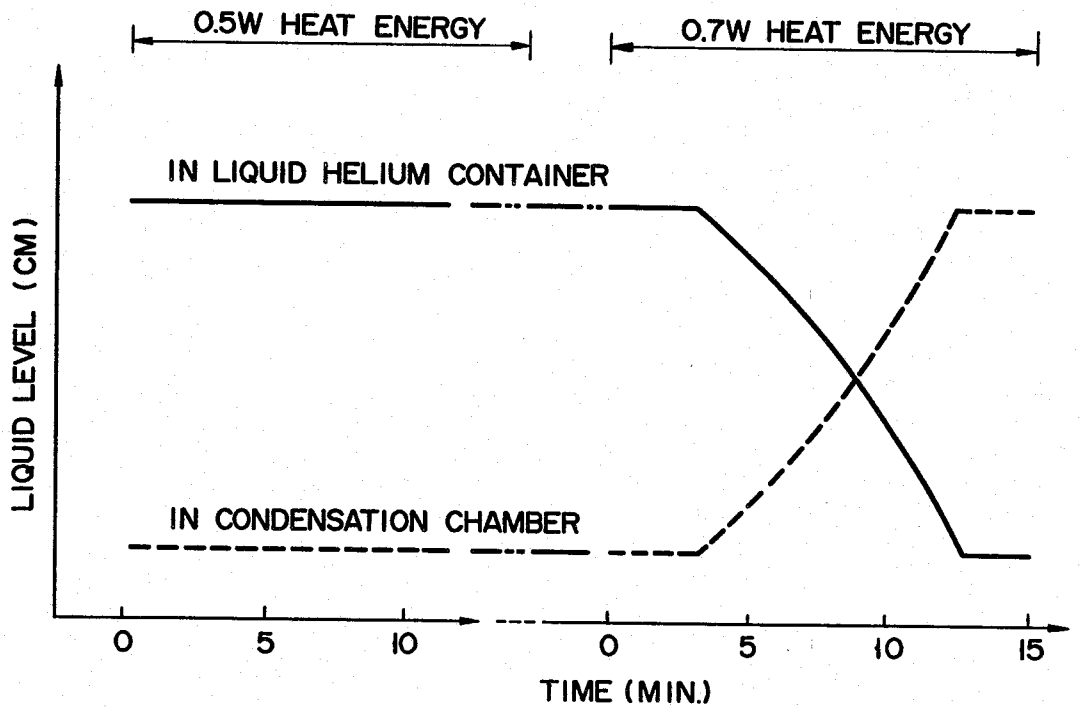
FIG. 2 (PRIOR ART)
FIG. 2 is a graph showing the level of the liquid helium in a helium container as a function of time and the level of the liquid helium in a condensation chamber as a function of time.
Figure 3:
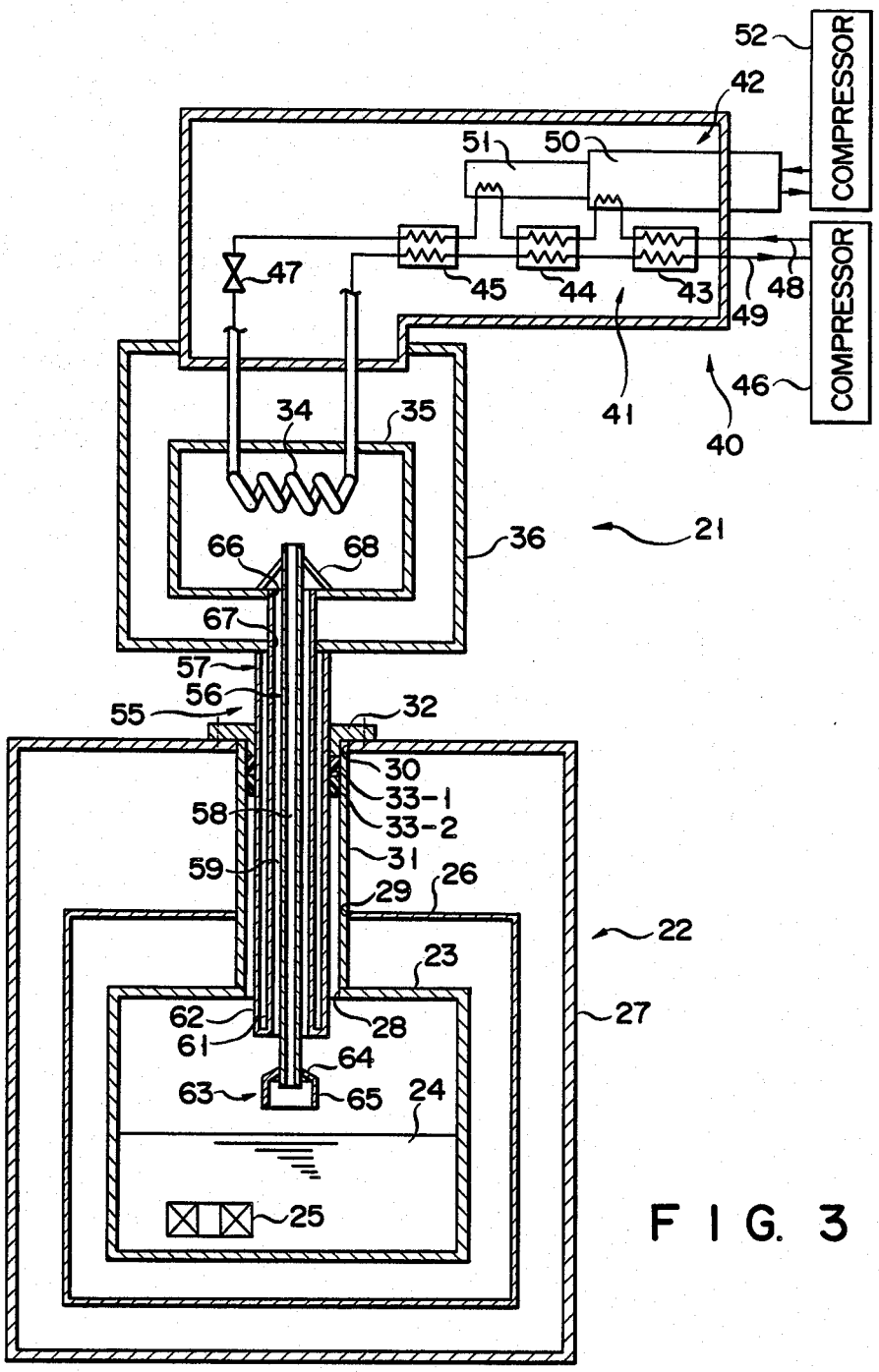
FIG. 3 is a sectional view of a helium cooling apparatus according to a first embodiment of the present invention.

The first embodiment FIG. 3 shows a helium cooling apparatus 21 according to a first embodiment of the present invention. The helium cooling apparatus 21 comprises a liquid helium container 23 adapted to store liquid helium 24 at a predetermined level. An object 25 to be cooled (e.g., a superconducting magnet) is immersed in the liquid helium 24. The liquid helium container 23 is arranged in a cryostat 22. The cryostat 22 comprises a heat-shielding plate 26 disposed to cover the liquid helium container 23 and a vacuum chamber 27 formed to cover the heat-shielding plate 26. The space between the container 23 and the plate 26 and the space between the plate 26 and the chamber 27 are kept in a vacuum state. The liquid helium container 23 is kept externally insulated. A circular port 28 is formed at the central portion of the upper wall of the liquid helium container 23. Holes 29 and 30 are formed at the central portions of the upper walls of the heat-shielding plate 26 and the vacuum chamber 27, respectively. A pipe 31 is connected to the port 28 and the holes 29 and 30. The interior of the liquid helium container 23 communicates with the external atmosphere through the pipe 31. A transfer tube 55 (to be described later) is inserted in the interior of the pipe 31. A cylindrical cock 32 arranged on the upper wall of the vacuum chamber 27 seals a gap between the inner surface of the upper end portion of the pipe 31 and the outer surface of the transfer tube 55. Two seal members 33-1 and 33-2 disposed below the cock 32 seal a gap between the inner surface of the upper end portion of the pipe e1 and the outer surface of the transfer tube 55. Therefore, the interior of the liquid helium container 23 is sealed from the external atmosphere. The pipe 31 is also utilized to supply liquid helium, to recover liquid helium, and to insert current supply lead wires.

The helium cooling apparatus 21 comprises a condensation chamber 35 incorporating a condensation heat exchanger 34 therein. The condensation chamber 35 is housed in a vacuum chamber 36. The heat exchanger 34 is connected to a refrigerator 40 for supplying a refrigerant to the heat exchanger 34. The refrigerator 40 comprises first and second cooling systems 41 and 42. The first and second cooling systems 41 and 52 are closed systems, respectively. The first cooling system 41 comprises three heat exchangers 43, 44, and 45. The heat exchanger 43 is connected to a compressor 46. An outgoing line 48 is connected from the compressor 46 to a Joule-Thomson valve 47 through the heat exchangers 43 to 45. The valve 47 is connected to the condensation heat exchanger 34. A return line 49 extending from the heat exchanger 34 is connected to the compressor 46 through the heat exchangers 43 to 45. The refrigerant flowing through the outgoing line 48 is cooled by the refrigerant flowing through the return line 49. The refrigerant flowing through the outgoing line 48 is also cooled by the second cooling system 42. More specifically, the second cooling system 42 comprises two heat exchangers 50 and 51. The heat exchanger 50 is connected to a compressor 52.

The refrigerator 40 is operated as follows. The compressors 46 and 52 are driven, and the refrigerant is flowed in the outgoing line 48. The temperature of the refrigerant at the time of delivery is about 300 K., and the refrigerant is cooled to about 16 K. by the heat exchangers 43, 50, 44, and 51. The refrigerant is further cooled to about 5 K. by the heat exchanger 45. The refrigerant is then expanded by the Joule-Thomson valve 47. The pressure of the refrigerant is decreased to about one atm., and its temperature is set at 4.2 K. The refrigerant is fed to the condensation heat exchanger 34 and is evaporated therein. The heat conduction surface of the condensation heat exchanger 34 is cooled. Therefore, the gas helium in the condensation chamber 35 is condensed into liquid helium.

The liquid helium container 23 communicates with the condensation chamber 35 through the transfer tube 55. In the first embodiment, the transfer tube 55 comprises a a cylindrical inner tube 56 and cylindrical outer tube 57 having a larger inner diameter than that of the inner tube 56 and coaxial therewith. The lower end portions of the inner and outer tubes 56 and 57 are open in the liquid helium container 23. The upper end portions of the tubes 56 and 57 are open in the condensation chamber 35. In this embodiment, the internal space in the inner tube 56 is defined as a gas helium flow path 58, and the space between the outer and inner tubes 57 and 56 is defined as a liquid helium flow path 59. For this reason, a gas helium guiding means 63 is arranged in the liquid helium container 23 to separate the gas helium from the liquid helium and to guide gas helium into the internal space of the inner tube 56. A liquid helium guiding means is arranged in the condensation chamber 35 to separate the liquid helium from the gas helium and to guide the liquid helium into the space between the outer and inner tubes 57 and 56.

The outer tube 57 has a double structure comprising a first tube 61 and a second tube 62 surrounding the first tube 61. For this reason, the interior of the first tube 61 is heat-insulated from the external atmosphere by the second tube 62. The lower end portion of the outer tube 57 (i.e., the lower end portions of the first and second tubes 61 and 62) extends into liquid the helium container 23. The lower end portion of the inner tube 56 extends downward from the lower end portion of the first tube 61. The gas helium guiding means 63 is mounted on the lower end portion of the inner tube 56, so as to guide the gas helium evaporated in the container 23 to the internal space of the inner tube 56 and to separate, from the gas helium, the liquid helium descending along the outer surface of the inner tube 56.

The gas helium guiding means 63 comprises a frustoconical member 64 which has an upper open end of a small-diameter, and a lower open end of a large-diameter. The upper open end is connected to the lower end portion of the inner tube 56. The gas helium guiding means 63 also comprises a cylinder 65 connected to the large-diameter portion of the frustoconical means 64 and having a lower open end and a larger inner diameter than the outer diameter of the inner tube 56. For this reason, the gas helium evaporated in the liquid helium container 23 is collected in the lower portion of the gas helium guiding means 65 and is guided to the interior of the inner tube 56. The liquid helium descending along the outer surface of the inner tube 56 is guided along the outer surfaces of the frustoconical member 64 and the cylinder 65 and can descend without being forced to ascend together with gas helium. Therefore, the gas helium guiding means 63 is designed such that it is mounted on the lower end portion of the inner tube 56 extending through the lower end portion of the first tube 61.

A port 66 is formed at the central portion of the lower wall of the condensation chamber 35. A hole 67 is formed at the central portion of the lower wall of the vacuum chamber 36. The first tube 61 of the outer tube 57 is inserted into the hole 67 of the vacuum chamber 36. The upper end portion of the first tube 61 is connected to the port 66 of the condensation chamber 35 but does not extend therein. The upper end portion of the second tube 62 of the outer tube 57 is mounted on the lower wall of the vacuum chamber 36. The upper end portion of the inner tube 56 extends into the condensation chamber 35 and is supported by a plurality of support members 68. For this reason, the liquid helium condensed in the condensation chamber 35 is separated from the gas helium exhausted from the upper end portion of the inner tube 56 and is guided from port the 66 of the condensation chamber 35 to the first tube 61. Therefore, the liquid helium guiding means is designed such that the upper end portion of the first tube 61 is connected to port the 66 of the condensation chamber 35, and the upper end portion of the inner tube 56 extends through the port 66 into the condensation chamber 35.

The gas helium evaporated in the liquid helium container 23 is collected to the lower portion of the gas helium guiding means 63 and is guided to the lower end portion of the inner tube 56. The gas helium ascends through the interior of the inner tube 56 (i.e., the gas helium flow path 58) and is exhausted from the upper end portion of the inner tube 56 to the condensation chamber 35. In this case, the refrigerator 40 is operated, and the temperature of the heat conduction surface of the condensation heat exchanger 34 is kept at 4.2 K. Therefore, the gas helium is condensed again to the liquid helium by the condensation heat exchanger 34. The liquid helium descends on the lower wall of the condensation chamber 35 and is collected in the upper end portion (i.e., the port 66) of the first tube 61 of the outer tube 57. The liquid helium descends by gravity through the space (i.e,., the liquid helium flow path 59) between the inner tube 56 and the first tube 61. The liquid helium further descends along the outer surface of the lower end portion of the inner tube 56, the outer surface of the frustoconical member 64, and the outer surface of the cylindrical member 65. Therefore, the liquid level in the liquid helium continer 23 is kept constant.

The gas helium flow path 58 is separated from the liquid helium flow path 59 in the transfer tube 55. For this reason, the gas helium does not interfere with the liquid helium. Therefore, the flooding phenomenon tends not to occur. Even if the inner diameter of the transfer tube 55 is not increased, the cooling capacity of the helium cooling apparatus is not degraded. In a conventional helium cooling apparatus, if the inner diameter of outer tube 57 is 5 mm and heat energy of 0.7 W or more is transferred to the liquid helium container 23, the flooding phenomenon occurs. In this case, it is difficult to provide a satisfactory cooling capacity of the helium cooling apparatus. However, according to the present invention, even if the inner diameter of the outer tube 57 is 5 mm and the energy of 0.7 W or more is transferred to the liquid helium container 23, the flooding phenomenon tends not to occur. For this reason, the helium cooling apparatus can have a satisfactory cooling capacity.

THE SECOND PREFERRED EMBODIMENT

Figure 4:
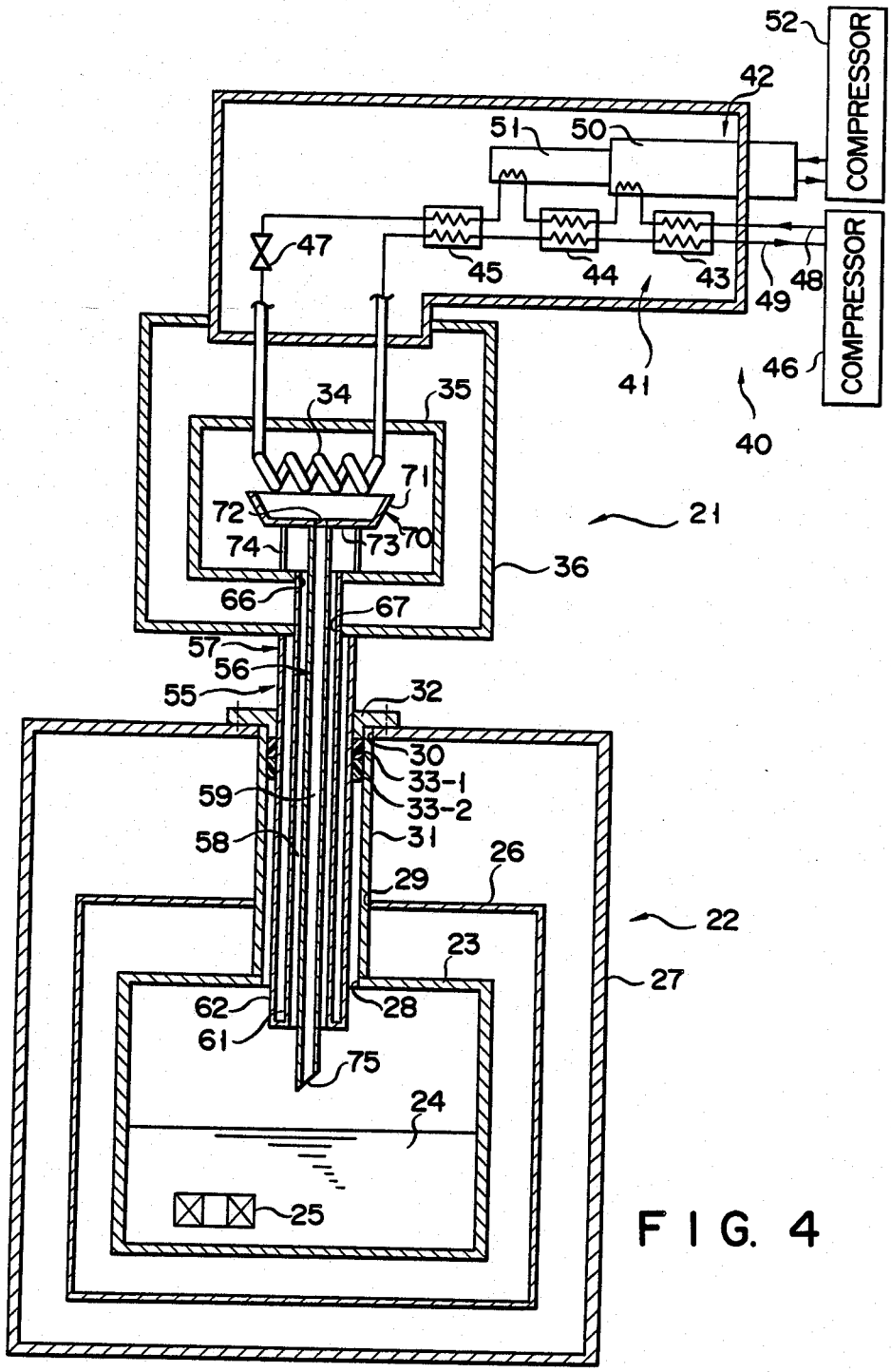
FIG. 4 is a sectional view of a helium cooling apparatus according to a second embodiment of the present invention.

A second embodiment of the present invention will be described with reference to FIG. 4.

In this embodiment, the transfer tube 55 also comprises inner and outer tubes 56 and 57. In this embodiment, however, the inner space of the inner tube 56 is defined as the liquid helium flow path 59, and the space between the inner tube 56 and the first tube 61 of the outer tube 57 is defined as the gs helium flow path 58. For this reason, the liquid helium guiding means is arranged in the condensation chamber 35 to separate the liquid helium from the gas helium and to guide the liquid helium to the internal space of the inner tube 56. A gas helium guiding means is arranged in the liquid helium container 23 to separate the gas helium from the liquid helium and to guide the gas helium to the space between the outer and inner tubes 57 and 56.

The upper end portion of the first tube 61 of the outer tube 57 is connected to the port 66 of the condensation chamber 35. The upper end portion of the inner tube 56 is inserted through the port 66 into the central portion of the condensation chamber 35. A reception tray 70 is mounted on the upper end of the inner tube 56 to receive the condensed liquid helium and to guide it to the upper end portion of the inner tube 56. The reception tray 70 is disposed below the condensation heat exchanger 34. The reception tray 70 comprises a conical side wall 71 and a bottom wall 73 having a port 72 connected to the upper end portion of the inner tube 56. The bottom wall 73 is supported by a plurality of support members 74. Therefore, the liquid helium condensed by the heat exchanger 34 is dropped on the bottom wall 73 of the reception tray 70. The liquid helium is guided to the port 72 and is supplied to the inner tube 56. For this reason, the liquid helium does not interfere with the gas helium which is supplied from the upper end portion (i.e., the port 66) of the first tube 61 to the condensation chamber 35. Therefore, the liquid helium guiding means is designed such that the reception tray 70 is mounted on the upper end of the inner tube 56 extending through the port 66 into the condensation chamber 35.

The lower end portion of the outer tube 57 (i.e., the lower end portions of the first and second tubes 61 and 62) is inserted into the liquid helium container 23. The lower end portion of the inner tube 56 extends through the lower end portion of the first tube 61 into the container 23. The liquid helium descended inside the inner tube 56 is exhausted from the lower end portion of the inner tube 56. For this reason, evaporated gas helium is automatically guided to the space between the first tube 61 and the inner tube 56. The gas helium guiding means is designed such that the lower end portion of the inner tube 56 is inserted through the lower end portion of the first tube 61 into the liquid helium container 23. Furthermore, the lower end portion of the inner tube 56 is obliquely cut. In other words, the lower end portion of the inner tube 56 comprises an inclined portion 75. For this reason, the liquid helium will drip from the lower end of the inner tube 56 for a short period of time.

The gas helium evaporated in the liquid helium container 23 is guided to the space (i.e., the gas helium flow path 58) between the inner tube 56 and the first tube 61. The gas helium is guided upward in the space between the inner tube 56 and the first tube 61. The gas helium is exhausted in the condensation chamber 35 through the port 66. Gas helium is condensed again into liquid helium by the condensation heat exchanger 34. The liquid helium drips on the bottom wall 73 of the reception tray 70. The liquid helium is supplied through the inner tube 56 (i.e., the liquid helium flow path 59) through the port 72 and descends through the inner tube 56. The liquid helium is exhausted from the inclined portion 75 of the inner tube 56 to the liquid helium container 23.

EFFECT OF THE CROSS-SECTION AREA RATIO OF THE FLOW PATHS

Figure 5:
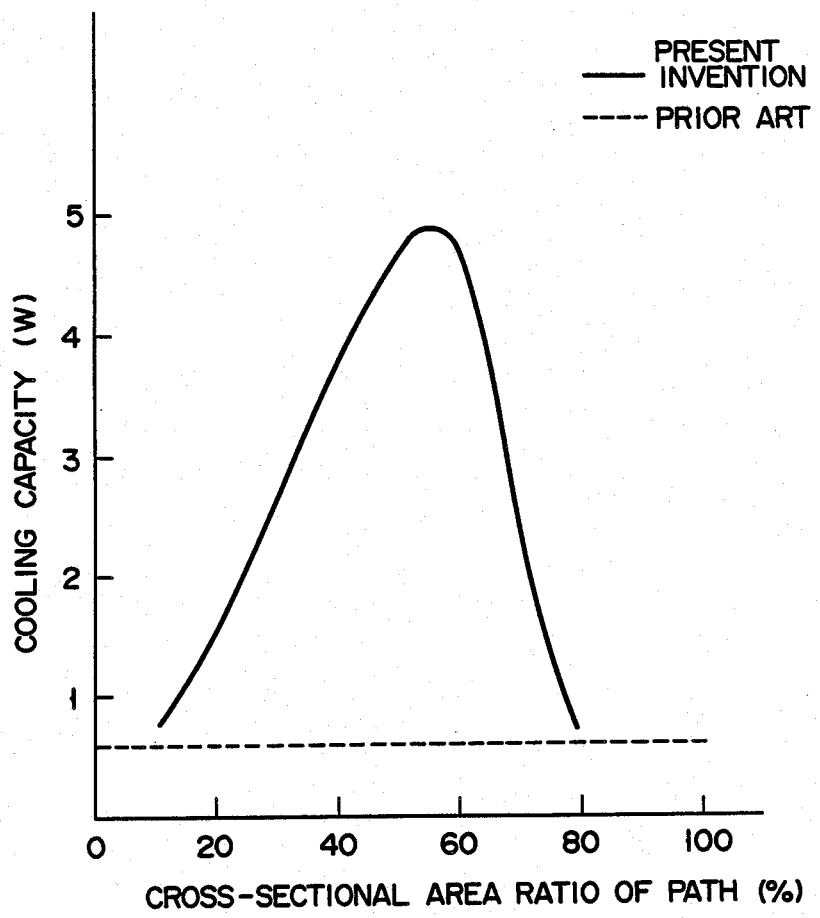
FIG. 5 is a graph showing the relationship between the cooling capacity and the cross-sectional area ratio of the flow paths.

The cross-sectional area ratio of the flow paths greatly influences the flow states of gas and liquid helium components. The present inventors examined the relationship between the ratio and the cooling capacity of the helium cooling apparatus. When the inner space of the inner tube 56 is defined as the gas helium flow path 58 and the inner diameter of the first tube 61 of the outer tube 57 is 5 mm, the relationship between the cooling capacity of the helium cooling apparatus and the ratio of (cross-sectional area of the gas helium flow path)/{(cross-sectional area of the gas helium flow path)+(cross-sectional area of the liquid helium flow path )} was calculated. The result is indicated by the solid line in FIG. 5. The cooling capacity of the conventional apparatus having a transfer tube (inner diameter: 5 mm) through which the gas helium together with the liquid helium flows is indicated by a broken line in FIG. 5. Referring to FIG. 5, as is apparent from the difference between the solid and broken lines, if the ratio corresponds to 50 to 60%, the cooling capacity of the helium cooling apparatus according to the present invention is maximum and is about eight times that of the conventional helium cooling apparatus. In this case, the flooding phenomenon in the transfer tube is assumed to rarely occur. Furthermore, as shown in FIG. 5, if the ratio is large or small, the cooling capacity is degraded because the narrow flow path may be slightly blocked by the helium. However, even if the ratio corresponds to 15% to 75%, the helium cooling apparatus has a larger cooling capacity than that of the conventional helium cooling apparatus, as can be seen from FIG. 5.

THE RELATIONSHIP BETWEEN HEAT TRANSFER AND PRESSURE

Figure 6:
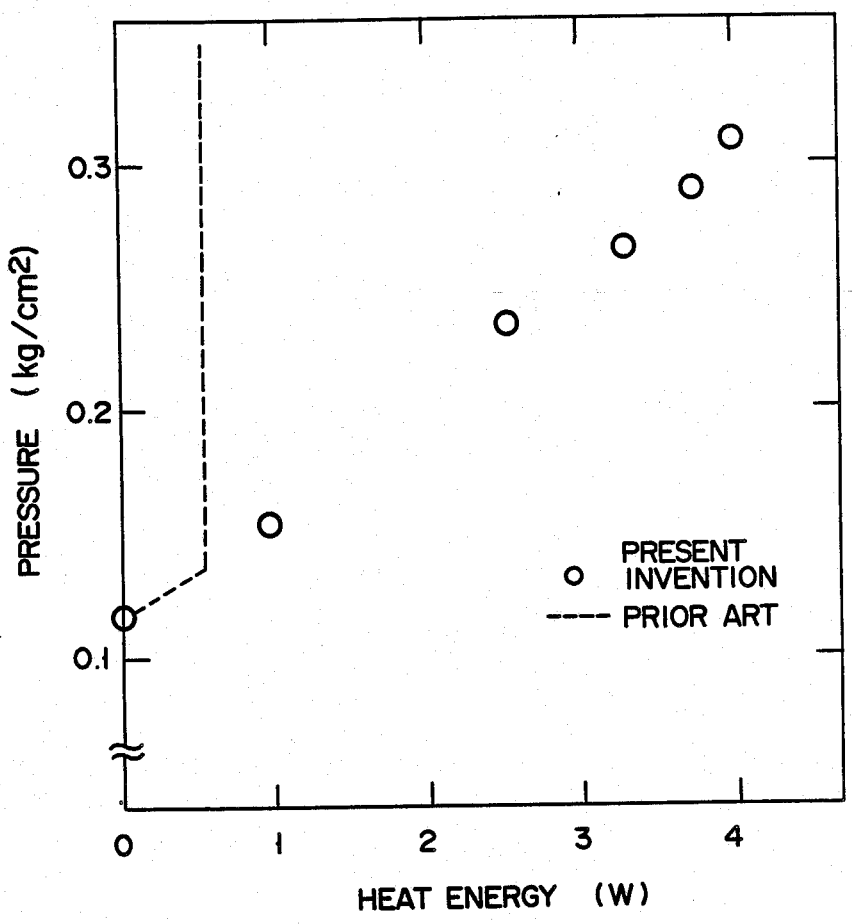
FIG. 6 is a graph of test results of the helium cooling apparatus according to the present invention, showing the relationship between a heat energy transferred to the liquid helium container and the pressure in the liquid helium container.

The present inventors conducted a test using the helium cooling apparatus of the first embodiment. The inner diameter of the inner tube of the transfer tube was 3.19 mm, and its outer diameter was 3.75 mm. The inner and uter diameters of the first tube of the outer tube were 5 mm and 6 mm, respectively. According to this test, the relationship between the pressure in the liquid helium container and the heat energy transferred to the liquid helium container was obtained upon operation of the helium cooling apparatus. The test result is plotted in FIG. 6. The relationship between the pressure in the liquid helium container and the energy transferred to the liquid helium container, upon operation of the conventional helium cooling apparatus, is indicated by the broken line in FIG. 6. As is apparent from FIG. 6, in the conventional apparatus, when the heat energy transferred to the container reaches a predetermined value, the pressure in the container is abruptly increased, and the cooling apparatus becomes inopertive, so that the flooding phenomenon occurs in the transfer tube. However, in the helium cooling apparatus according to the present invention, even if the heat energy transferred to the container is increased, the pressure in the container is only slightly increased. Therefore, it is assumed that the flooding phenomenon rarely occurs and that the cooling capacity of the helium cooling apparatus is not decreased. Therefore, it is demonstrated that the present invention provides the above effect.

The present invention is not limited to the particular embodiments described above. The outer and inner tubes of the transfer tube may be cylindrical, and their material and shape are not limited to specific ones. In addition, the shape of the reception tray may be any shape if it can cover the lower portion of the condensation heat exchanger and guide dropping liquid helium to the inner tube. The refrigeration capacity of the refrigerator is not limited to about 4 W.

What is claimed is:

1. A helium cooling apparatus comprising:

(a) a liquid helium container which, in use, stores liquid helium;

(b) a condensation chamber incorporating a condensation heat exchanger for condensing gas helium into liquid helium; and (c) a transfer tube for allowing said liquid helium container to communicate with said condensation chamber, said transfer tube including a gas helium flow path and a liquid helium flow path that is independent of said gas helium flow path, wherein:

(d), when the liquid helium in said liquid helium container is evaporated into gas helium, the gas helium is supplied to said condensation chamber through said gas helium flow path and is condensed by said condensation heat exchanger into liquid helium and the liquid helium is guided to said liquid helium container through said liquid helium flow path and (e) the ratio of (cross-sectional area of the gas helium flow path)/[(cross-sectional area of the gas helium flow path)+(cross-sectional area of the liquid helium flow path)] is between 0.15 and 0.85.

2. An apparatus according to claim 1, wherein said transfer tube includes:

(a) an inner tube having an inner space, an upper end portion open to said condensation chamber, and a lower end portion open to said liquid helium container and (b) an outer tube surrounding said inner tube, having a diameter larger than that of said inner tube to form a space therebetween, and having an upper end portion open to said condensation chamber and a lower end portion open to said liquid helium container, so that the inner space of said inner tube is defined as said gas helium flow path and the space between said outer and inner tubes is defined as said liquid helium flow path.

3. An apparatus according to claim 2, wherein said outer tube includes a first tube and a second tube surrounding said first tube with a predetermined distance therebetween.

4. An apparatus according to claim 1, wherein said transfer tube includes:

(a) an inner tube having an upper end portion open to said condensation chamber and a lower end portion open to said liquid helium container and (b) an outer tube having a diameter larger than that of said inner tube, surrounding said inner tube, and having an upper end portion open to said condensation chamber and a lower end portion open to said liquid helium container, so that an internal space in said inner tube is defined as said liquid helium flow path and the space between said outer and inner tubes is defined as said gas helium flow path.

5. An apparatus according to claim 4, wherein said outer tube includes a first tube and a second tube surrounding said first tube with a predetermined distance therebetween.

6. A helium cooling apparatus comprising:

(a) a liquid helium container which, in use, stores liquid helium;

(b) a condensation chamber incorporating a condensation heat exchanger from condensing gas helium into liquid helium;

(c) a transfer tube for allowing said liquid helium container to communicate with said condensation chamber, said transfer tube including:

(i) an inner tube having an upper end portion open to said condensation chamber and a lower end portion open to said liquid helium container and (ii) an outer tube having a diameter larger than said inner tube, surrounding said inner tube, and having an upper end portion open to said condensation chamber and a lower end portion open to said liquid helium container;

(d) gas helium guiding means for separating the gas helium evaporated in said liquid helium container from the liquid helium and guiding the gas helium to an internal space of said inner tube, in order to define the internal space of said inner tube as a gas helium flow path; and (e) liquid helium guiding means for separating the liquid helium condensed in said condensation chamber from the gas helium and for guiding the liquid helium to a space between said inner and outer tubes, in order to define the space between said inner and outer tubes as a liquid helium flow path, so that, when the liquid helium in said liquid helium container is evaporated into gas helium, the gas helium is guided to said condensation chamber through the internal space of said inner tube and condensed by said condensation heat exchanger into liquid helium, and the liquid helium is guided to said liquid helium container through the space between said inner and outer tubes, (f) wherein the ratio of (cross-sectional area of the gas helium flow path)/[(cross-sectional area of the gas helium flow path)+(cross-sectional area of the liquid helium flow path)] is between 0.15 and 0.85.

7. An apparatus according to claim 6, wherein said gas helium guiding means includes a guide member:

(a) which is mounted on the lower end portion of said inner tube extending through the lower end portion of said outer tube;

(b) which guides the gas helium evaporated in said liquid helium container to the internal space of said inner tube; and (c) which separates the liquid helium dropping in the space between said inner and outer tubes from the gas helium and causes the liquid helium to drop.

8. An apparatus according to claim 7, wherein said guide member includes a frustoconical member which has an upper open end having a small-diameter and a lower open end having a large-diameter, said upper open end being connected to the lower end portion of said inner tube.

9. An apparatus according to claim 8, wherein said guide member further includes a cylinder:

(a) which is connected to said upper open end of said frustoconical member;

(b) which has a lower open end; and (c) which has an inner diameter larger than the outer diameter of said inner tube.

10. An apparatus according to claim 6, wherein:

(a) said condensation chamber has a port;

(b) said gas helium guiding means is arranged such that the upper end portion of said outer tube is connected to said port of said condensation chamber; and (c) the upper end portion of said inner tube extends through said port of said condensation chamber into said condensation chamber.

11. A helium cooling apparatus comprising:

(a) a liquid helium container which, in use, stores liquid helium;

(b) a condensation chamber incorporating a condensation heat exchanger for condensing gas helium into liquid helium;

(c) a transfer tube for allowing said liquid helium container to communicate with said condensation chamber, said transfer tube including:

(i) an inner tube having an upper end portion open to said condensation chamber and a lower end portion open to said liquid helium container and ((ii) an outer tube having a diameter larger than said inner tube, surrounding said inner tube, and having an upper end portion open to said condensation chamber and a lower end portion open to said liquid helium container;

(d) gas helium guiding means for separating the gas helium evaporated in said liquid helium container from the liquid helium and for guiding the gas helium to a space between said inner and outer tubes, in order to define the surface between said inner and outer tubes as a gas helium flow path; and (e) liquid helium guiding means for separating the liquid helium condensed in said condensation chamber from the gas helium and for guiding the liquid helium to an internal space of said inner tube, in order to define the internal space of said inner tube as a liquid helium flow path, so that the liquid helium in said liquid helium container is evaporated into gas helium, the gas helium is guided to said condensation chamber through the space between said inner and outer tubes and condensed by said condensation heat exchanger into liquid helium, and the liquid helium is guided to said liquid helium container through the internal space of said inner tube, (f) wherein the ratio of (cross-sectional area of the gas helium flow path)/[(cross-sectional area of the gas helium flow path)+(cross-sectional area of the liquid helium flow path)] is between 0.15 and 0.85.

12. An apparatus according to claim 11, wherein said gas helium guiding means is arranged such that the lower end portion of said inner tube extends through the lower end portion of said outer tube into said liquid helium container.

13. An apparatus according to claim 12, wherein the lower end portion of said inner tube is obliquely cut.

14. An apparatus according to claim 11, wherein said liquid helium guiding means includes a reception tray:.

(a) which is mounted on the upper end portion of said inner tube that extends through the upper end portion of said outer tube into said condensation chamber;

(b) which is located below said condensation heat exchanger; and (c) which receives the condensed liquid helium and guides the condensed liquid helium to the internal space of said inner tube.

15. An apparatus according to claim 14, wherein said reception tray further comprises a conical side wall and a bottom wall coupled to said conical side wall, said bottom wall having a port coupled to the upper end portion of said inner tube.

* * * * *